US006390965B1

(12) United States Patent
Matsushima

(10) Patent No.: US 6,390,965 B1
(45) Date of Patent: May 21, 2002

(54) CENTRIFUGAL SEPARATOR HAVING SLIDING LINKED RACKS PARTS FOR EASY INSERTION AND REMOVAL INTO THE ROTOR

(75) Inventor: Souithirou Matsushima, Oomiya (JP)

(73) Assignee: Tomy Kogyo Co., Ltd., Saitama-ken (JP)

( * ) Notice: Subject to any disclaimer, the term of this patent is extended or adjusted under 35 U.S.C. 154(b) by 0 days.

(21) Appl. No.: 09/482,266

(22) Filed: Jan. 13, 2000

(30) Foreign Application Priority Data

Jun. 29, 1999 (JP) ..... 11-183213
Nov. 5, 1999 (JP) ..... 11-315872

(51) Int. Cl.[7] ..... B04B 5/02
(52) U.S. Cl. ..... 494/16
(58) Field of Search ..... 494/16, 20, 21, 494/31, 33

(56) References Cited

U.S. PATENT DOCUMENTS 330,779 A * 11/1885 Frederiksen et al.
330,780 A * 11/1885 Frederiksen et al.
4,301,964 A * 11/1981 Cowell
4,341,342 A * 7/1982 Hara
4,427,406 A * 1/1984 Nielsen ..... 494/16
4,941,867 A * 7/1990 Tominaga ..... 494/20
5,411,465 A * 5/1995 Glen et al. ..... 494/16
5,538,493 A * 7/1996 Gerken et al. ..... 494/16
6,045,494 A * 4/2000 Toyama ..... 494/16

FOREIGN PATENT DOCUMENTS

DE 3341323 * 5/1985 ..... 494/16
FR 2537281 * 6/1984 ..... 494/16

* cited by examiner

*Primary Examiner*—Charles E. Cooley
(74) *Attorney, Agent, or Firm*—Varndell & Varndell, PLLC

(57) ABSTRACT

A centrifugal separator having a cylindrical bottomed main rotor body, and a rack configured with a plurality of rack parts along the inner circumferential surface of the main rotor body, which rack parts are linked together and are able to move in radial directions of the main rotor body, so that when the main rotor body is rotated, the rack parts are pressed against the inner circumferential surface of the main rotor body and held there by the centrifugal forces associated with the rotating of the main rotor body.

5 Claims, 10 Drawing Sheets

CENTRIFUGAL SEPARATOR HAVING SLIDING LINKED RACKS PARTS FOR EASY INSERTION AND REMOVAL INTO THE ROTOR

BACKGROUND OF THE INVENTION

1. Field of the Invention

The present invention relates to a centrifugal separator, and particularly to a rotor structure.

2. Description of the Related Art

In the centrifugal separator 100 diagramed in FIG. 9, a motor 101 is installed via elastic bodies 103 to flanges 102*a* formed inside a frame 102. To the drive shaft 104 of this motor 101, a rotor 105 is engaged so as to be freely removable.

In this centrifugal separator, the rotor 105 is formed in a disc shape. On the upper surface periphery of the rotor 105 is formed an inclined surface 105*a* that is inclined toward the inside and downward. In this inclined surface 105*a*, tube (test tube) insertion holes 106 are formed.

Now, a rotor 105 such as this is formed by machining an aluminum block or the like into a disc shape and then cutting the inclined surface 105*a*, using a lathe or the like, and thereafter making the tube insertion holes 106 with a drill or the like. Accordingly, the machining becomes intricate and costly. Also, with such a rotor 105 as this, a certain thickness is required in the peripheral portion of the rotor 105 for forming the tube insertion holes 106, resulting in increased weight. Accordingly, the motor 101 must have a sufficient capacity therefore, whereupon the centrifugal separator must be made large. In order to lighten the rotor 105, the center portion of the rotor 105 (the portion where the drive shaft 104 of the motor 101 is attached) and portions other than those portions needed for forming the tube insertion holes 106, indicated by the double-dotted lines in FIG. 9, can be cut away, but that results in the shape of the rotor 105 becoming complex and machining that is much more intricate. Furthermore, in order to accommodate other types of tubes having different diameters, other rotors 105 must be made available that are provided with tube insertion holes 106 having diameters corresponding to those other tubes, resulting in escalating costs.

In a centrifugal separator 110 diagramed in FIG. 10, a rotor 111 is configured by a main rotor body 112 provided with a plurality of holes 112*a* in the upper surface periphery of a disc, and cubical racks 113 loaded in the main rotor body 112. With this rotor 111, the main rotor body 112 is engaged to the drive shaft 104 of the motor 101, and the racks 113 are accommodated, respectively, in the holes 112*a* in that main rotor body With such a rotor 111 as this, in order to prevent the weight from being displaced to one side, the multiple racks 113 must be accommodated respectively in the holes 112*a* of the main rotor body 112 symmetrically about the center of the drive shaft 104 to achieve balance. Since the operation of accommodating these racks 113 in the main rotor body 112 is intricate, and each of the racks 113 is formed independently, not all that many tube insertion holes (not shown) can be formed in the upper surface of the racks 113.

SUMMARY OF THE INVENTION

Thereupon, an object of the present invention is to provide a centrifugal separator rotor that is both lightweight and easy to machine.

Another object of the present invention is to provide a centrifugal separator rotor wherewith the rack loading operation is simple, and the number of tube insertion holes can be increased.

Yet another object of the present invention is to provide a centrifugal separator rotor that can easily and inexpensively be made to accommodate various tube types.

In order to achieve the objects stated above, the centrifugal separator of the preset invention comprises: a cylindrical bottomed main rotor body; and a rack configured with a plurality of rack parts along the inner circumferential surface of the main rotor body, the rack parts of which are linked together and are able to move in radial directions of the main rotor body; wherein: when the main rotor body is being turned, the rack parts are pressed against the inner circumferential surface of the main rotor body and held there by the centrifugal forces associate with the turning of the main rotor body.

As based on the centrifugal separator of this invention, the rotor is made up of the main rotor body and the rack, respectively, as separate parts, wherefore the shape thereof can be simplified and machining made easy.

More specifically, because the main rotor body of the centrifugal separator of this invention can be a shape that stops the rack on the inner circumferential surface thereof, the main rotor body may have the simple structure of a bottomed cylinder, whereby the rotor can be made lighter in weight and less costly. It is also possible to form the rack of lightweight parts of plastic or the like, which not only facilitates cost reduction but also makes it possible to make the motor, etc., smaller, and thus to make the centrifugal separator both smaller and lighter in weight. Furthermore, when tubes are loaded into the rotor, the tubes can be loaded into a rack at another location beforehand and that rack then can be accommodated in the main rotor body. Thus, work efficiency is improved because only the lightweight rack need be moved, and tubes can be loaded into racks at other locations.

In a centrifugal separator of the present invention, moreover, a disc Is provided which fits tightly and integrally to the main rotor body at the center part thereof, and the multiple rack parts are linked together via the circumferential edge of the disc.

With the centrifugal separator of this invention, after mounting the rack parts about the circumferential edge of the disc, the disc is fit tightly on to the center part of the main rotor body. In this condition, when the main rotor body is driven so that it turns, the rack parts move out in radial directions due to centrifugal force, and are stopped when they come up against the inner circumferential surface of the main rotor body.

That is, with the centrifugal separator of this invention, the disc need only position the rack, and-need not have the strength required to hold the rack. Also, the rack is stopped by the inner circumferential surface of the main rotor body, due to the centrifugal force generated when the main rotor body is driven so that it turns, wherefore it is only necessary that the main rotor body retain sufficient strength, and thus the rotor can be made lighter.

In centrifuge operations, moreover, tubes are loaded into a rack at a different location beforehand, so that it is only necessary to mount the disc on which do racks have been mounted to the main rotor body. That is, only lightweight racks need be carried about, which makes the work easier.

In a centrifugal separator of the present invention, further more, a hub is erected in the center of the main rotor body. Splines are formed which extend upward and downward on the outer circumferential surface of the hub, and a spline hole is formed in the center of the disc. By pushing the spline hole of the disc down onto the splines of the main rotor body, the disc is made to fit tightly on the main rotor body.

With the centrifugal separator of this invention, the disc can be made to fit tightly to the main rotor body by pushing the center of the disc down onto the hub erected in the center of the main rotor body, wherefore the operation of mounting a rack on the main rotor body is extremely simple.

In a centrifugal separator of the present invention, moreover, grooves are formed in the inner circumferential surface of the rack parts. These grooves are made to mate with the circumferential edge of the disc, and, at the same time, the rack parts are mounted to the disc by pins inserted into the rack parts and the disc.

With the centrifugal separator of this invention, rack grooves are mated with the circumferential edge of the disc and the rack parts are held by the disc, wherefore the rack parts are securely held by the disc.

In a centrifugal separator of the present invention, furthermore, the rack is formed in a ring shape. At multiple locations in this rack, one slit is formed in a radial direction so as to completely cut and separate the rack, and slits are made in radial directions which cut the rack while leaving a portion of the inner circumferential edge thereof. The rack parts are formed by these slits so that they are divided.

As based on the centrifugal separator of this invention, the rotor is fabricated by a main rotor body and a rack, respectively, as separate parts, wherefore the shape is simplified and machining is made easy.

More specifically, the main rotor body need only be of a shape that will stop the rack with the inner circumferential surface thereof, wherefore the main rotor body can have the simple structure of a bottomed cylinder, and hence the rotor can be made lighter in weight and less costly. It is also possible to form the rack of lightweight parts made of plastic or the like, as a consequence costs can be reduced, the motor made smaller, and the centrifugal separator made both smaller and lighter in weight. Furthermore, when loading tubes into the rotor, the tubes can be loaded beforehand into a rack at a different location and then that rack accommodated in the main rotor body, so that it is only necessary to move the lightweight racks, making the work easier and enhancing work efficiency.

With the centrifugal separator of this invention, furthermore, the rack parts are formed integrally so that they do not separate, wherefore the number of tube insertion holes can be increased. In order to accommodate different types of tubes, moreover, it is only necessary to have racks that conform to the different tube types, using the same main rotor body in common, wherefore costs can be kept low.

In a centrifugal separator of the present invention, moreover, either projections or concavities are formed in the main rotor body while concavities or projections, respectively, are formed in the rack, so that the rack can be engaged with the main rotor body by those projections or concavities, such that the rack will be restricted to the same direction of turning as the main rotor body.

As based on the centrifugal separator of this invention, the engagement between the main rotor body and the rack can be implemented in a simple configuration, making it easy to mount the rack on the main rotor body.

In a centrifugal separator of the present invention, furthermore, the rack is configured with a ring-shaped main rack that is accommodated inside the main rotor body and auxiliary racks that accommodate pluralities of tubes, and auxiliary rack accommodation holes that are formed about the entire circumference of the main rack.

As based on the centrifugal separator of this invention, tubes are accommodated in tube-holding holes in the auxiliary racks, those racks are accommodated beforehand in the auxiliary rack accommodation holes in the main rack, and that [main rack] is accommodated inside the main rotor body. Accordingly, if auxiliary racks are provided which have tube-holding holes corresponding to different types of tubes, the main rack body and the main rack can be used commonly and costs reduced accordingly.

In a centrifugal separator of the present invention, moreover, projections or concavities are formed on the upper surface of one rack while concavities or projections, respectively, are formed in the lower surface of another rack, the other rack is mounted on the first rack, and the concavities or projections in the other rack in the upper stage are mated with the projections or concavities, respectively, in the first rack in the lower stage, thereby restricting the other rack in the upper stage to the same turning direction as the first rack in the lower stage.

With the centrifugal separator of this invention, the rack in the upper stage is restricted to the same circumferential direction as the rack in the lower stage by mating the concavities or projections in the rack in the upper stage with the projections or concavities, respectively, of the rack in the lower stage, thus making it possible to simultaneously centrifuge tubes accommodated in multiple stages of racks. This is very efficient, and makes it possible to simultaneously perform centrifuge operations on racks of different types, and, hence, on tubes of different types.

DESCRIPTION OF THE PREFERRED EMBODIMENTS

Figure 1:
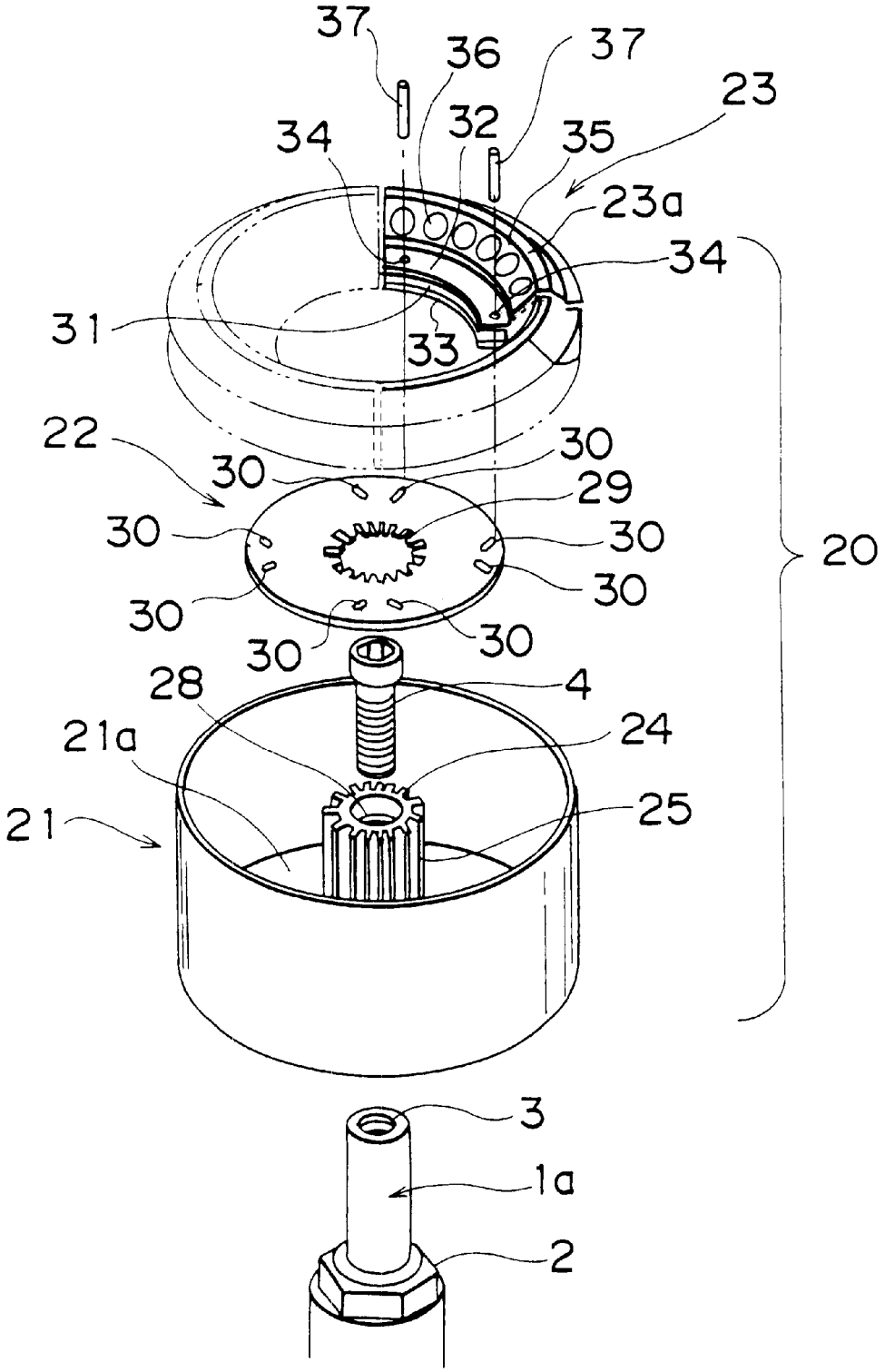
FIG. 1 is an exploded diagonal view of an aspect of one embodiment of a centrifugal separator relating to the present invention.
Figure 2:
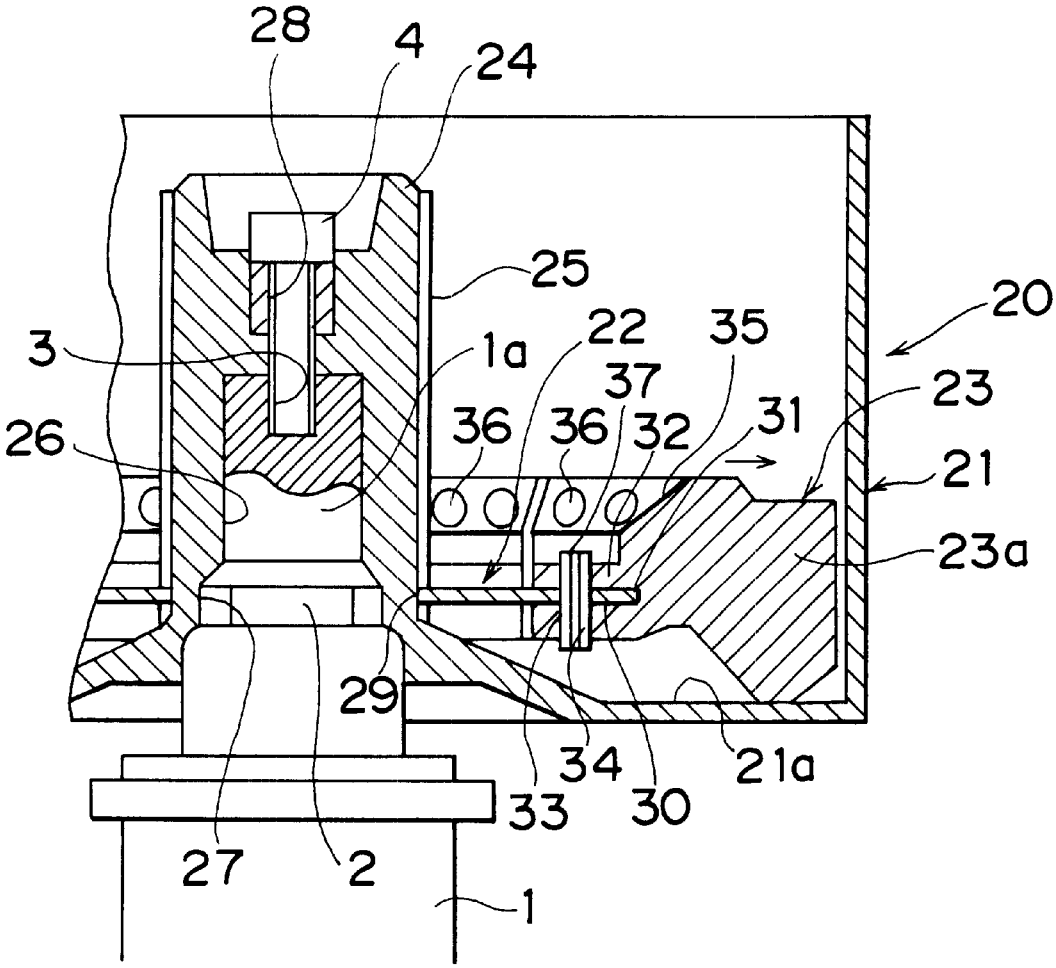
FIG. 2 is an enlarged cross-sectional view of the main parts of the rotor diagramed in FIG. 1, showing how they are assembled.
Figure 3:
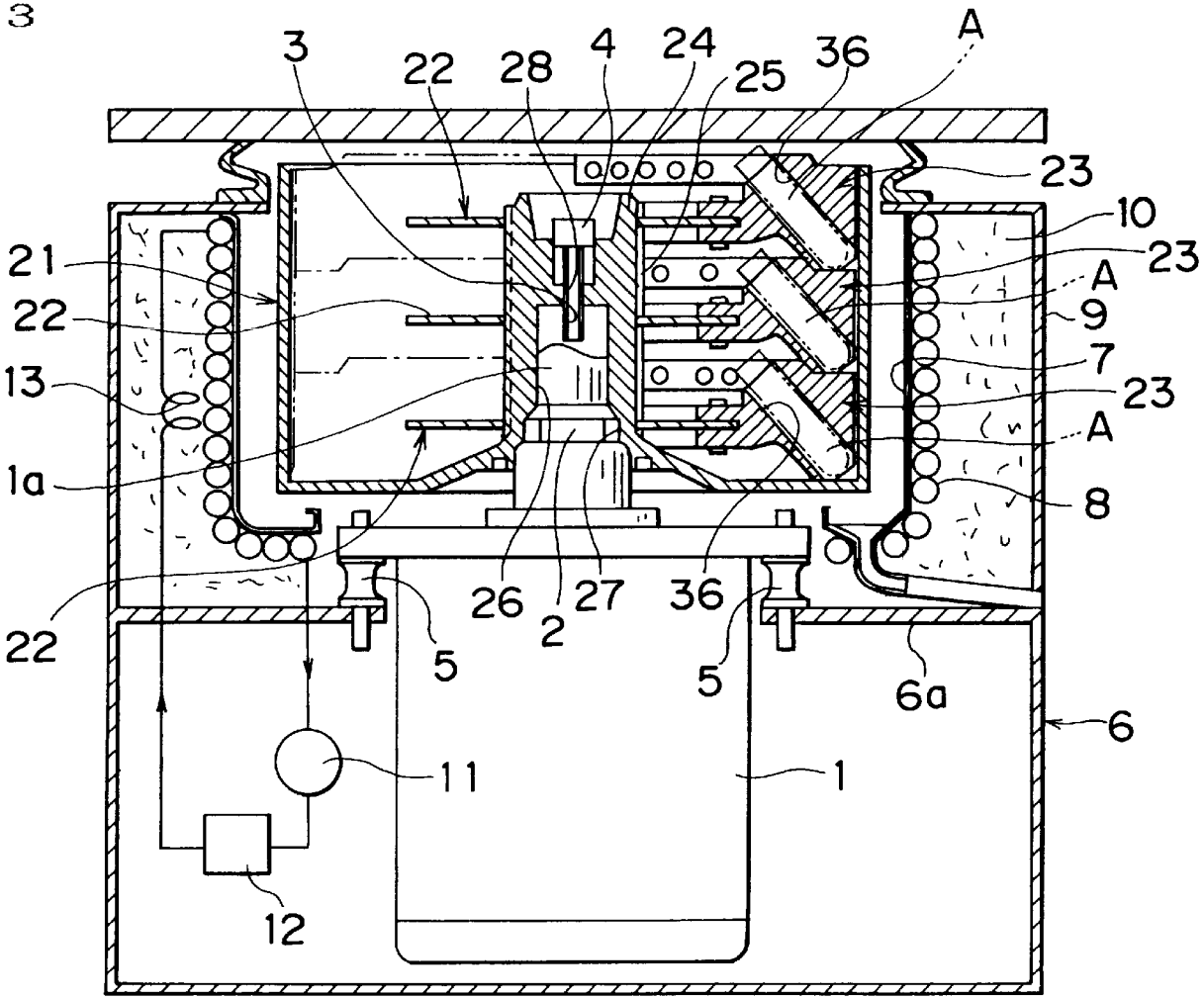
FIG. 3 is a cross-sectional view showing how the racks diagramed in FIG. 1 are assembled in multiple, stages in the main rotor body.

An aspect of one embodiment of a rotor in a centrifugal separator relating to the present invention is represented in FIGS. 1 to 3.

A rotor 20 in this centrifugal separator is configured by a main rotor body 21, a disc 22, and a rack 23, etc.

The main rotor body 21 is shaped as a bottomed cylinder, provided with a hub 24 in the center thereof protruding toward the inside. Splines 25 are formed about the circumferential surface of this hub 24, parallel to the axial centerline thereof. In the hub 24 a hole 26 is formed that opens at the lower surface of the bottom wall 21*a* of the main rotor body 21, as diagramed in FIG. 2, and a hexagonal concavity 27 is formed in the circumferential surface at the opening of that hole 26. In the hub 24, moreover, a bolt insertion hole 28 is formed that allows the hole 26 to penetrate to the upper surface.

To a motor drive shaft 1*a*, meanwhile, a hexagonal convexity 2 is formed, about the circumference thereof, as diagramed in FIG. 1.

Then, as diagramed in FIG. 2, when the hole 26 in the main rotor body 21 is mated to the motor drive shaft 1*a*, the concavity 27 fits down over the convexity 2 in the motor drive shaft 1*a*. Next, a bolt 4 is inserted from the bolt insertion hole 28 in the main rotor body 21, the tip thereof is screwed into the female-threaded hole 3 in the drive shaft 1*a*, and the main rotor body 21 is thus coupled to the motor drive shaft 1*a*. Accordingly, the main rotor body 21 has its turning relative to the motor drive shaft 1*a* restricted by the engagement between the concavity 27 and the convexity 2 in the motor drive shaft 1*a*.

The disc 22 has, in the center thereof, a spline hole 29 corresponding to the splines 25 in the hub 24, and also has four sets of long holes 30 about the circumferential edge thereof. In each set of long holes 30, two holes are formed within the range of a quarter circle ([at angles of] 45° with the center). These long holes 30 are formed so that they are mutually parallel.

The turning of this disc 22 relative to the main rotor body 21 is restricted by the mating of this spline hole 29 with the spines 25 in the hub 24 of the main rotor body 21.

The rack 23 is configured by combining together four rack parts 23*a* formed by cutting a doughnut ring shape roughly into quarters. Each rack part 23*a* is formed in a circular arc that forms roughly a quarter circle. In the inner circumferential surface of each of these circular-arc shaped rack parts 23*a* is formed an arc-shaped groove 31 that is open at that inner circumferential surface. In the upper and lower lip pieces 32 and 33 that define that groove 31 two holes 34 are formed that penetrate those pieces. These holes 34 are formed at positions corresponding to the long holes 30 in the disc 22.

The rack parts 23*a* have inclined surfaces 35 formed on the upper surface thereof so that they face inward. In each inclined surface 35 are formed six tube accommodation holes 36.

This rack part 23*a* is manipulated so that the groove 31 therein is mated with the circumferential edge of the disc 22, the holes 34 in the rack part 23*a* are matched with the holes 30 of the disc 22, and spring pins 37 are inserted into those holes 34 and 30, thus holding the rack part 23*a* to the disc 22. Each rack part 23*a* held to the disc 22 in this manner can move in the radial direction of the disc 22 because the pins 37 can move within the long holes 30 in the disc 22.

In a centrifugal separator rotor 20 configured in this way, the rack parts 23*a* are mounted by mating their grooves 31, respectively, with the circumferential edge of the disc 22, and spring pins 37 are inserted respectively into the holes 34 in the rack parts 23*a* and into the long holes 30 in the disc 22 to hold the rack parts 23*a* to the circumferential edge of the disc 22. Then, after loading tubes A into the holes 36 in the rack 23 configured in this manner by assembling the rack parts 23 in a ring shape, the spline hole 29 of the disc 22 is mated to the splines 25 of the hub 24 of the main rotor body 21. Repeating this operation, racks 23 are sequentially stacked in upper stages, as diagramed in FIG. 3.

In FIG. 3, moreover, in this centrifugal separator, a motor 1 having the drive shaft 1*a* is mounted to flanges 6(*a*) of a frame 6 via elastic bodies 5. In the upper part of the frame 6, an inner case 7 is deployed so that it encloses the rotor 20. A cooling line 8 is wound about the outer circumferential surface of the inner case 7. An outer case 9 is deployed about the periphery of the inner case 7, and the space between the outer case 9 and inner case 7 is filled with thermal insulation 10. One end of the cooling line 8 is passed through a compressor 11, condenser 12, and capillary tube 13 and connected to the other end of the cooling line 8 thereby configuring a cooling system.

When the rack 23 has been set in the main rotor body 21 in this way, if the rotor 20 is not being turned, a slight gap is opened between the outer circumferential surface of the rack parts 23*a* and the inner circumferential surface of the main rotor body 21, as diagramed in FIG. 2 and FIG. 3. Then, when the main rotor body 21 is driven so that it turns, centrifugal forces operate on the rack parts 23*a*, the spring pins 37 in the rack parts 23*a* move outward in radial directions along the long holes 30 in the disc 22, and, as a consequence, each rack part 23*a* comes up against and is stopped by the inner circumferential surface of the main rotor body 21.

That is, with the rotor 20 of this invention, the centrifugal forces that develop in the rack parts 23*a* are stopped by the inner circumferential surface of the main rotor body 21, wherefore the disc 22 need only position the rack parts 23*a*, and need not have strength sufficient to securely hold the rack 23. Accordingly, by forming the disc 22 of something having a thin wall thickness and forming the rack parts 23*a* with the minimum capacity required for inserting the tubes A, the rotor 20 can be made lightweight.

In the embodiment aspect described in the foregoing, the rack parts 23*a* are mounted to the disc 22 with spring pins 37, but it is also permissible, for example, to form female threads in the holes 34 in the lip 33 in the rack parts 23*a* and use screws instead of the spring pins 37, whereupon the screws may be inserted into the holes 34 in the lips 32 of the rack pieces 23*a* and the long holes 30 in the disc and their tips screwed into the holes 34 in the lip 33. In other words, if the rack parts 23*a* are deployed along the inner circumferential surface of the main rotor body 21, and the circumferential direction thereof is restricted relative to the main rotor body 21, so that, when centrifugal forces act on the rack parts 23*a*, the rack parts 23*a* can move outward in radial directions so that they come up against the inner circumferential surface of the main rotor body 21 due to those centrifugal forces, that is sufficient to hold the racks in place.

With the embodiment aspect described in the foregoing, moreover, a disc 22 is used, and the arc-shaped rack parts 23*a* are coupled to the circumferential edge of the disc 22 to configure a ring-shaped rack 23, but it is permissible to mutually couple the side surfaces of adjacent rack parts 23*a* to assemble them into a ring shape, and to position these along the inner circumferential surface of the main rotor body 21, without using a disc 22. In that case, it is desirable that adjacent rack parts 23*a* be coupled so that the rack parts 23*a*, respectively, can independently move outward in radial directions so that they come up against the inner circumferential surface of the main rotor body 21. It is also desirable that the rack 23 have its circumferential direction restricted relative to the main rotor body 21 by such means as stoppers.

Figure 4:
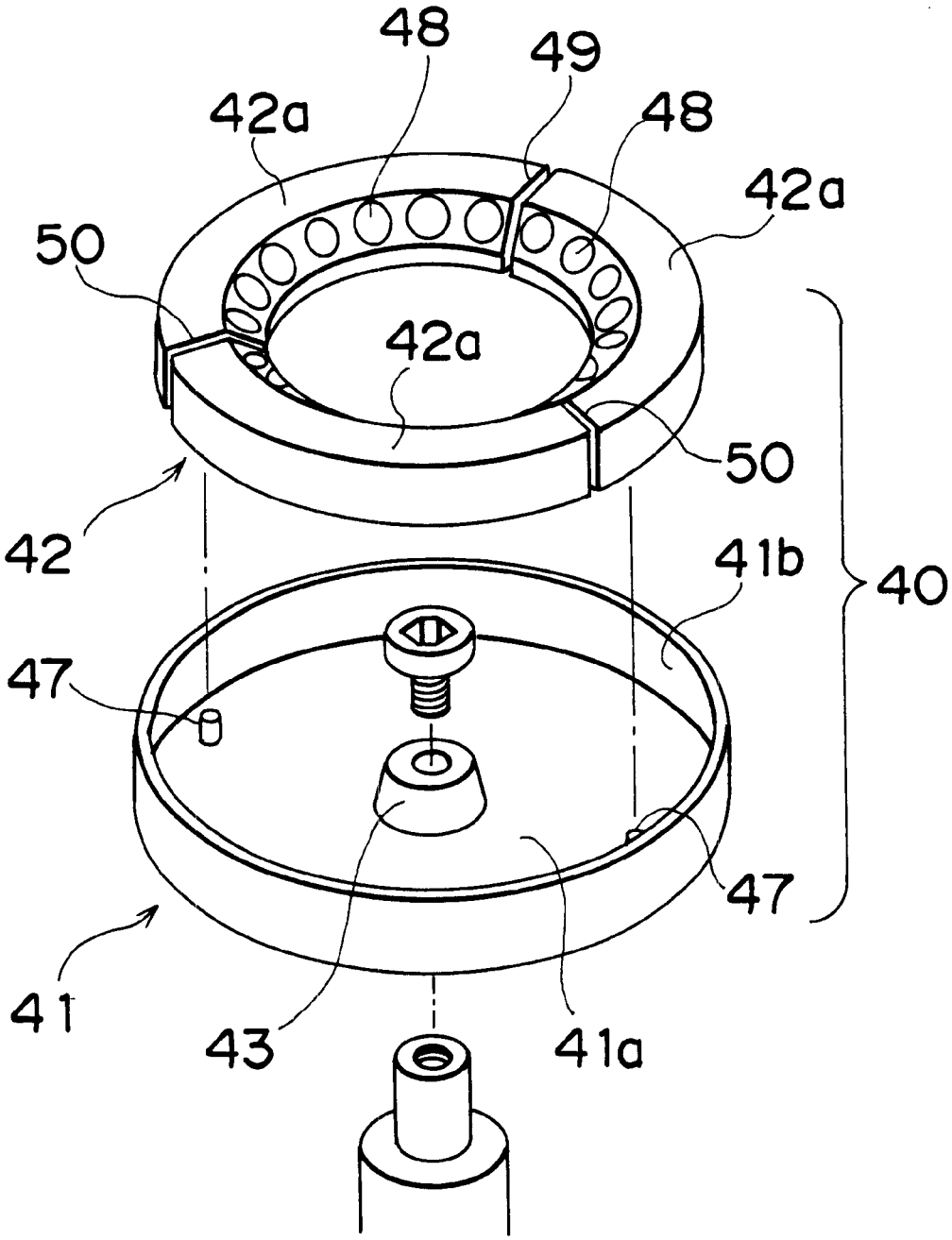
FIG. 4 is an exploded diagonal view of an aspect of another embodiment of a rotor in a centrifugal separator relating to the present invention.
Figure 5:
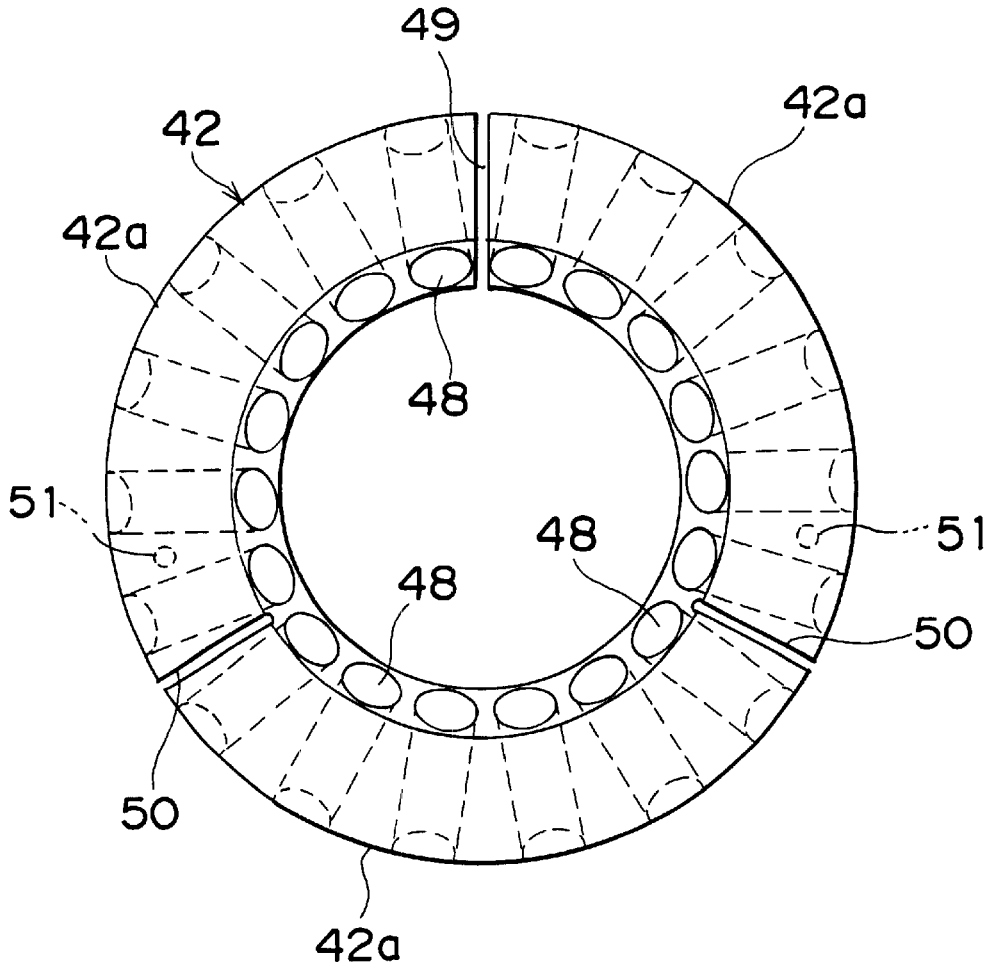
FIG. 5 is a plan of a rack in the rotor diagramed in FIG. 4.
Figure 6:
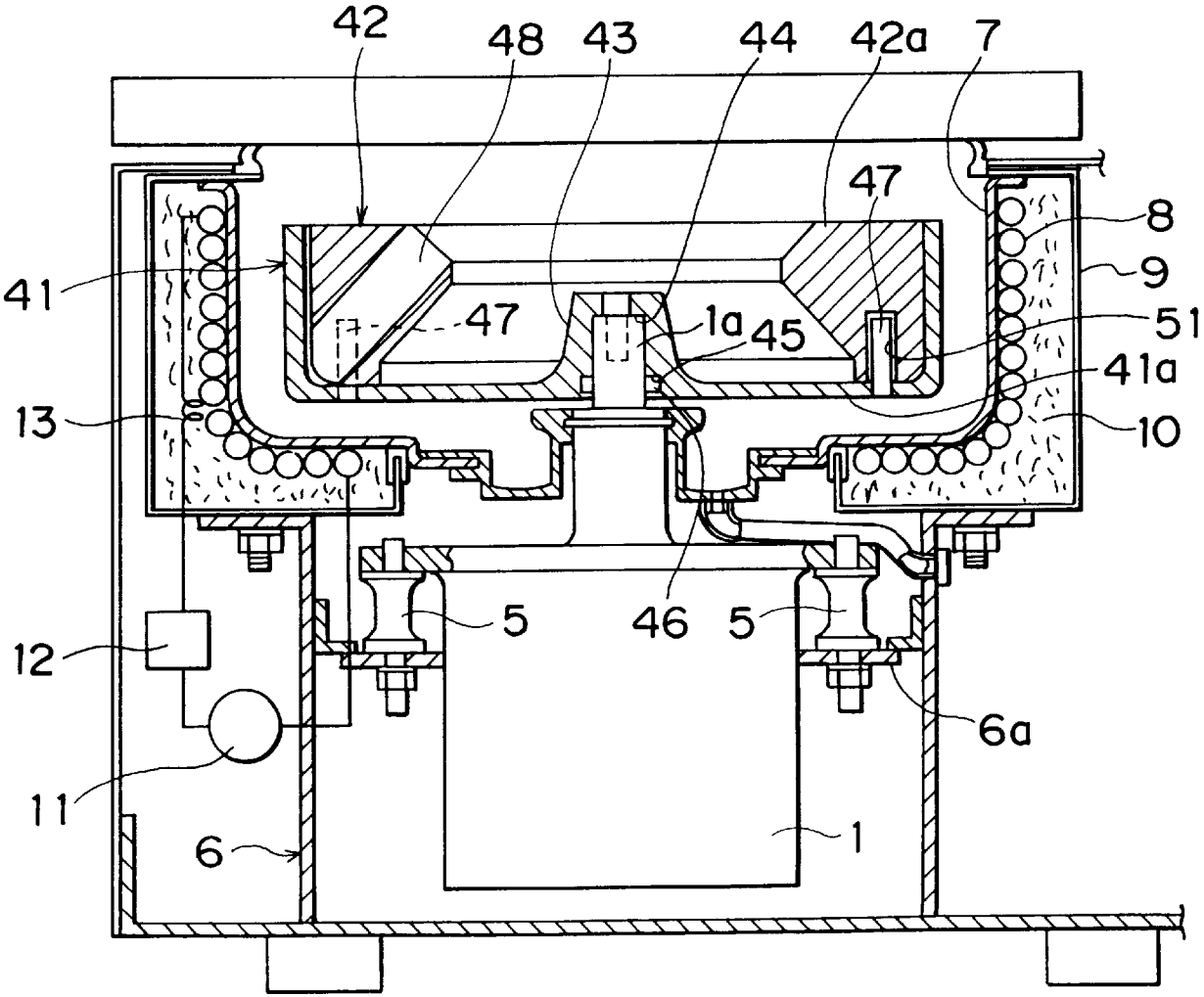
FIG. 6 is a cross-sectional view showing how the rotor diagramed in FIG. 4 is assembled.

An aspect of another embodiment of a rotor in a centrifugal separator relating to the present invention is represented in FIGS. 4 to 6.

A rotor 40 in this centrifugal separator is configured by a main rotor body 41 and a rack 42.

The main rotor body 41 is shaped as a bottomed cylinder, provided with a hub 43 protruding in the center toward the inside. In this hub 43 a concavity 44 is formed, from the lower surface of the bottom wall 41*a* of the main rotor body 41, as diagramed in FIG. 6, and a cut-out 45 is made in the opening in this concavity 44 extending in a radial direction. Then, when the concavity 44 in the main rotor body 41 is mated with the motor drive shaft 1*a*, the cut-out 45 mates with a pin 46 implanted in the motor drive shaft 1*a*, and the turning of the main rotor body 41 relative to the motor drive shaft 1*a* is restricted. In addition, positioning pins 47 are erected in the upper surface of the bottom wall 41*a* of the main rotor body 41.

The rack 42 forms a ring, and inclined tube holding holes 48 are formed about the entire circumference in the inner circumferential surface thereof. Also, as diagramed in FIG. 5, a slit 49 is formed in this rack 42, at one location in the circumferential direction thereof, to completely separate the rack 42 in a radial direction, and slits 50 are also formed at two more locations therein, having cuts made therein which leave the inner circumferential portion of the circumferential edge. The rack 42 is thus delineated by these slits 49 and 50 into a plurality of rack parts 42*a* (three parts in the diagram). Also, as diagramed in FIG. 6, holes 51 are formed in the bottom surface of the rack 42 so that, by mating these holes 51 with the positioning pins 47 in the main rotor body 41, the turning of the rack 42 relative to the main rotor body 41 is restricted. The holes 51 are formed slightly larger than the diameters of the pins 47 to permit movement of the rack parts 42*a* outward in radial directions due to the centrifugal forces described below.

With a centrifugal separator configured in this way, the concavity 44 in the main rotor body 41 is mated with the motor drive shaft 1*a*, the cut-out 45 therein is mated with the pin 46 in the motor drive shaft 1*a*, and the turning of the main rotor body 41 relative to the motor drive shaft 1*a* is restricted. Also, the holes 51 in the rack 42 are mated with the pins 47 in the main rotor body 41, and the rack 42 is restricted to the same turning direction as the main rotor body 41. Either before or after setting the rack 42 in the main rotor body 41, the tubes (not shown) are loaded in the rack 42. Then the motor 1 is driven. Thereupon, centrifugal force develops in each of the rack parts 42*a* in the rack 42, and each rack part 42*a* opens out in the direction of the ring-shaped circumferential wall of the main rotor body 41 and comes up against that circumferential wall 41*b*. The rack parts 42*a* are therefore held stable in the main rotor body 41.

In the aspect of the embodiment described in the foregoing, furthermore, the tube holding holes 48 are formed facing downward, but, in the centrifugal separator of the present invention, these holes 48 may of course be formed in either vertical or horizontal directions.

In the aspect of the embodiment described in the foregoing, moreover, the holes 51 formed in the rack parts 42*a* may have a circular cross-section or an elliptical cross-section.

In the aspect of the embodiment described in the foregoing, furthermore, pins 47 are erected in the main rotor body 41 and holes 51 corresponding to those pins 47 are formed in the rack parts 42*a*, but it is also permissible to form projections having some other shape than the pins 47 in the main rotor body 41 to form concavities corresponding to those projections in the rack parts 42*a*, or, conversely, to form concavities in the main rotor body 41 and form projections in the rack parts 42*a*.

In the aspect of the embodiment described in the foregoing, moreover, the pins (projections) 47 are formed on the upper surface of the bottom wall 41*a* of the main rotor body 41, and the holes (concavities) 51 are formed on the lower surface of the rack parts 42*a*, but those may be formed in the circumferential wall of the main rotor body 41 and the circumferential walls of the rack parts 42*a*.

In the centrifugal separator diagramed in FIG. 6 also, as in the centrifugal separator diagramed in FIG. 3, a motor 1 having a drive shaft 1*a* is mounted on flanges 6(*a*) in a frame 6 via elastic bodies 5. In addition, an inner case 7 is deployed in the upper part of the frame 6 so as to enclose the rotor 40, and a cooling line 8 is wound about the outer circumferential surface of that inner case 7. An outer case 9 is also deployed about the periphery of the inner case 7, and the space between the outer case 9 and inner case 7 is filled with thermal insulation 10. One end of the cooling line 8 is passed through a compressor 11, condenser 12, and capillary tube 13 and connected to the other end of the cooling line 8 to configure a cooling system.

Figure 7:
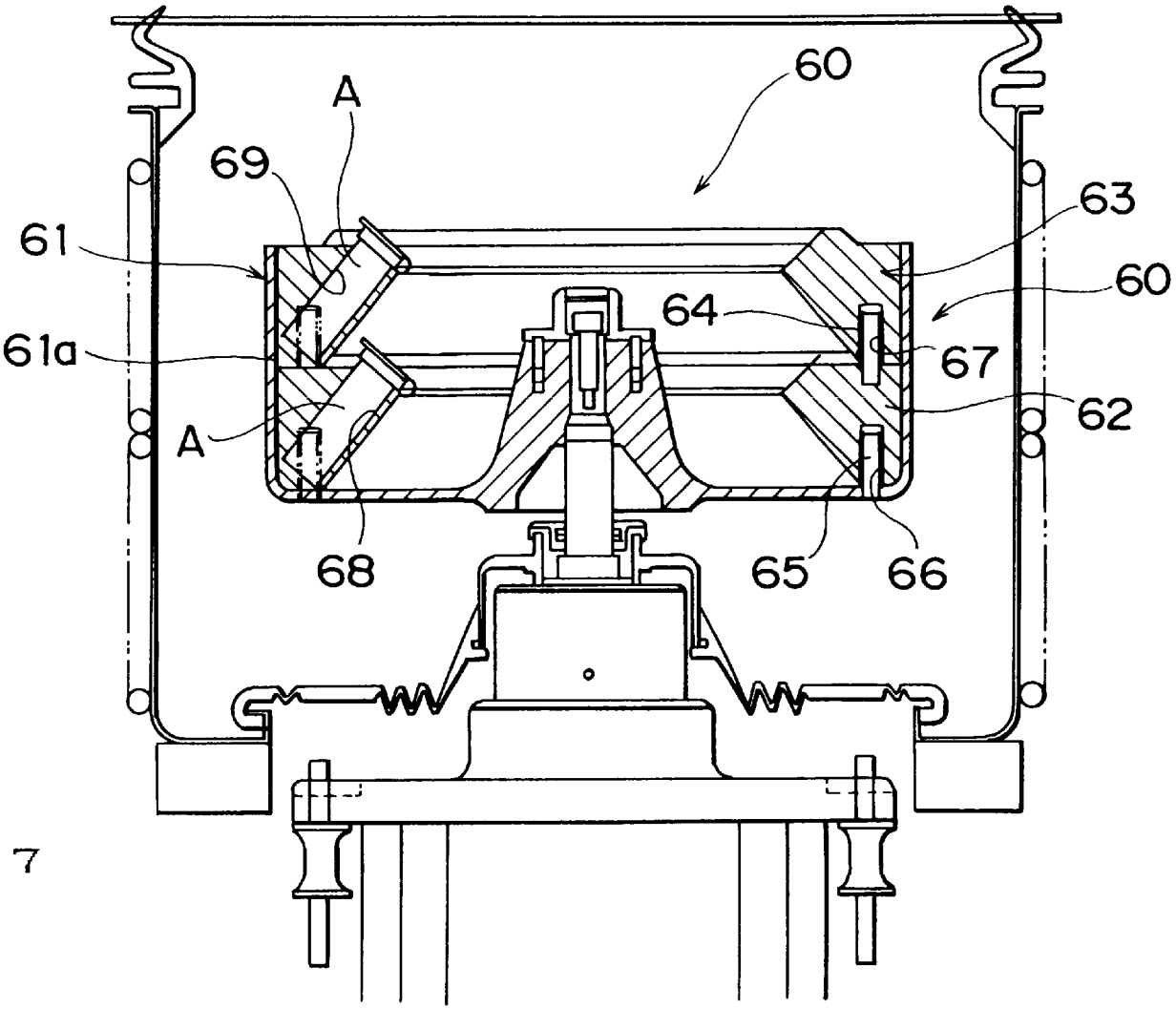
FIG. 7 is a cross-sectional view of an example modification of the rotor diagramed in FIG. 4, showing how the rotor is assembled.

In FIG. 7, another modification example of the rotor diagramed in FIGS. 4 to 6 is diagramed. This modification example is configured so that the rack diagramed in FIGS. 4 to 6 is mounted in two stages in the main rotor body.

In this embodiment aspect, the rotor 60 is basically the same as the rotor 40 described above, but, inside a main rotor body 61, in order to accommodate racks 62 and 63 in two stages, the side wall 61*a* is formed higher than the side wall in the main rotor body 41 in the embodiment aspect described above, and pins 64 are implanted in the upper surface of the rack 62 in the lower stage.

The structure of the parts other than the main rotor body 61 in the rotor 60 are the same as diagramed in FIGS. 4 to 6, and the shapes and positions of the pins 65 are the same as for the pins 47 described earlier. The parts other than the racks 62 and 63, such, for example, as the overall shape of the rack 42, and the positions and shapes of the slits 49 and 50, etc., in the aspect of the embodiment diagramed in FIGS. 4 to 6, are formed similarly. The holes 66 and 67 formed in the racks 62 and 63, and the tube holding holes 68 and 69, are also no different, in terms of shape and position, than the holes 51 and 48 in the rack 42 described earlier.

In this modification example, furthermore, in activating the rotor 60, tubes A are loaded in the tube holding holes 68 in the lower-stage rack 62, the holes 66 in that lower-stage rack 62 are mated with the pins 65 in the main rotor body 61, and the rack 62 is loaded in the main rotor body 61. Similarly, tubes A are loaded in the tube holding holes 69 in the upper-stage rack 63, the holes 67 in that upper-stage rack 63 are mated with the pins 64 in the lower-stage rack 62, and the rack 63 is mounted on the lower-stage rack 62 and thus loaded in the main rotor body 61.

Figure 8:
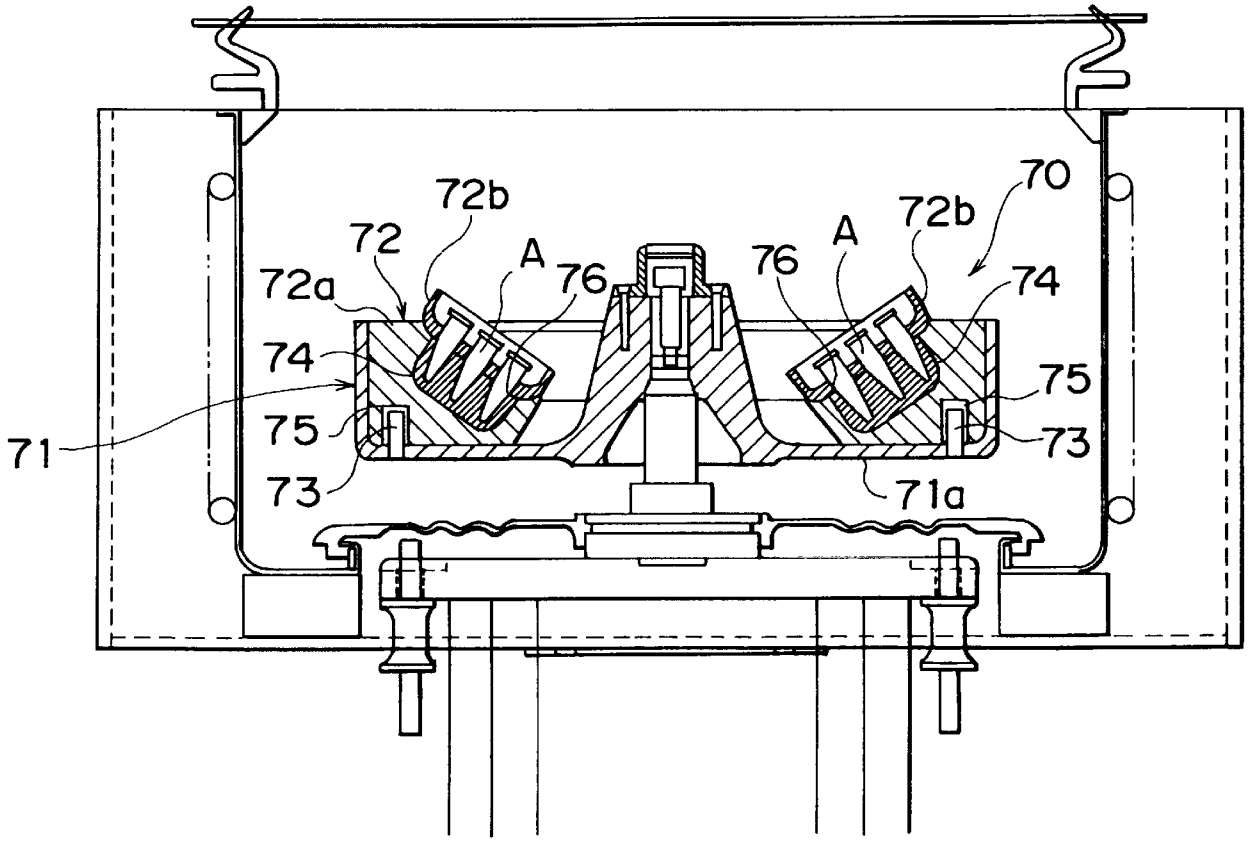
FIG. 8 is a cross-sectional view of another example modification of the rotor diagramed in FIG. 4, showing how the rotor is assembled.
Figure 9:
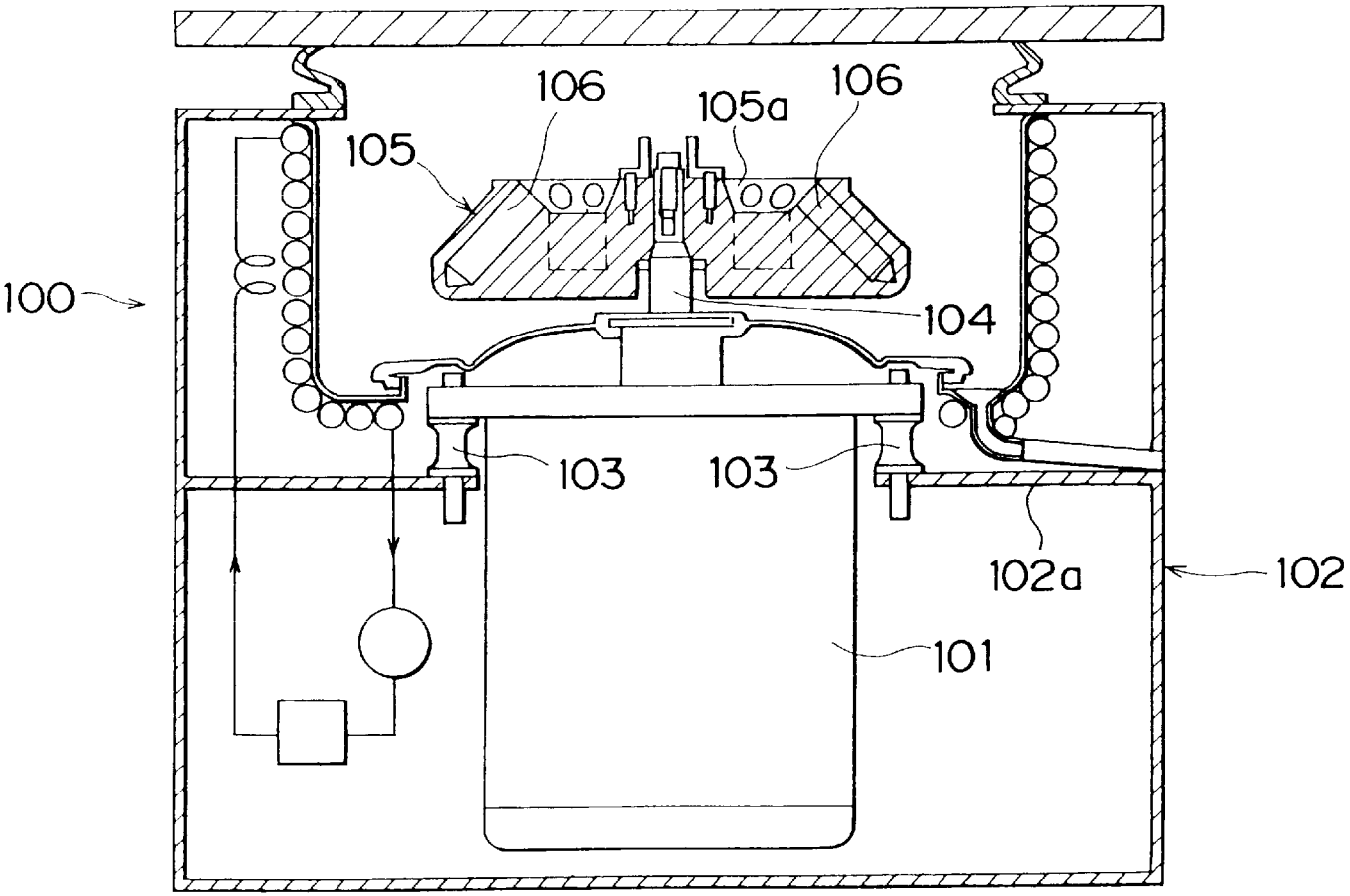
FIG. 9 PRIOR ART
FIG. 9 is a conceptual cross-sectional view of a centrifugal separator comprising a conventional rotor.
Figure 10:
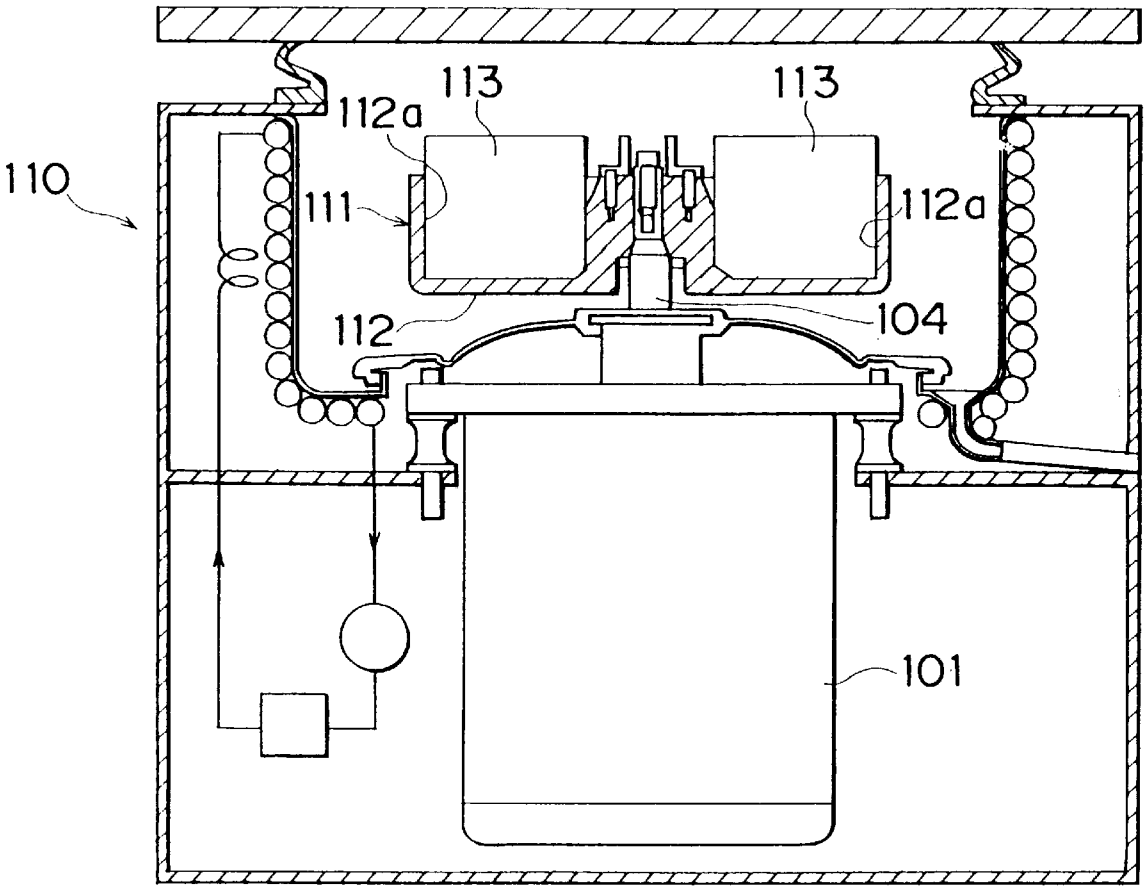
FIG. 10 PRIOR ART
FIG. 10 is a conceptual cross-sectional view of a centrifugal separator comprising another conventional rotor.

In FIG. 8 is diagramed a modification example of the rotor diagramed in FIGS. 4 to 6. This modification example is also configured by a main rotor body 71 and a rack 72, as in the embodiment aspects described earlier. The main rotor body 71 is shaped as a bottomed cylinder, as is the main rotor body 41 in an embodiment aspect described earlier, and pins 73 are erected on the upper surface of a bottom wall 71*a*.

The rack 72, however, is configured by a main rack 72*a* and auxiliary racks 72*b*. The main rack 72*a* forms a ring as does the rack 42 in the embodiment aspect described earlier. On the inner circumferential surface thereof, multiple auxiliary rack accommodation holes 74 are formed about the entire circumference, which are inclined, and holes 75 are formed in the lower surface thereof. The auxiliary racks 72*b* each have a plurality of tube holding holes 76 for accommodating tubes A.

Then, when activating the rotor 70, tubes A are loaded in the tube holding holes 76 in the auxiliary racks 72*b*, those auxiliary racks 72*b* are loaded in the auxiliary rack accommodation holes 74 in the main rack 72*a*, the holes 75 in that main rack 72*a* are mated with the pins 73 in the main rotor body 71, and the main rack 72*a* is thus loaded in the main rotor body 71.

The positions and shapes, etc., of the parts other than the main rack 72*a* in the rotor 70 are formed in the same way as the overall shape of the rack 42 and the positions and shapes, etc., of the slits 49 and 50 in the embodiment aspects described earlier, and there are no differences in the functions thereof. The main rotor body 71 is the same, moreover, as the main rotor body 41 in the embodiment aspect described earlier.

What is claimed is:

1. A centrifugal separator comprising:

a cylindrical bottomed main rotor body;

a rack configured with multiple rack parts arranged along an inner circumferential surface of said main rotor body, said rack parts being linked together and able to move in radial directions of said main rotor body; said rack being formed in a ring shape; and at multiple locations in said rack, one slit is formed in a radial direction so as to completely cut and separate said rack, and other slits are made in radial directions which cut said rack while leaving a portion of an inner circumferential edge thereof; and said rack parts are formed so as to be divided by these slits;

projections are formed on an upper surface of a first rack while concavities are formed on a lower surface of another rack; said other rack is mounted on said first rack; and said concavities in said other rack in an upper stage are mated with said projections respectively, in said first rack in a lower stage, thereby restricting said other rack in the upper stage to same turning direction as that of said first rack in said lower stage.

2. A centrifugal separator comprising:

a centrifugal bottomed main rotor body;

a hub being erected in a center of said main rotor body, splines being formed on an outer circumferential surface of said hub, said splines extending upward and downward;

a disc having a spline hole at a center of said disc, said disc fitting tightly and integrally to said main rotor body by pushing said spline hole of said disc onto said splines of said hub;

a rack configured with multiple rack parts arranged along an inner circumferential surface of said main rotor body; said rack parts being linked together via a circumferential edge of said disc and able to move in radial directions of said main rotor body; wherein:

when said main rotor body is being turned, said rack parts are pressed against said inner circumferential surface of said main rotor body and made stationery there by centrifugal forces associated with turning of said main rotor body.

3. A centrifugal separator comprising:

a centrifugal bottomed main rotor body, projections are formed in an upper surface of bottom wall of said main rotor body;

a rack configured with multiple rack parts arranged along an inner circumferential surface of said main rotor body, concavities being formed in a lower surface of said rack, said rack parts being linked together and able to move in radial directions of said main rotor body, said rack having a ring shape; and at multiple locations in said rack, one slit is formed in a radial direction so as to completely cut and separate said rack, and other slits are made in radial directions which cut said rack while leaving a portion of inner circumferential edge thereof; and said rack parts are formed so as to be divided by these slits;

wherein said rack is engaged with said main rotor body by said projections and concavities, such that said rack is restricted to same direction of turning as said main rotor body, and when said main rotor body is being turned, said rack parts are pressed against said inner circumferential surface of said main rotor body and made stationery there by centrifugal forces associated with turning of said main rotor body.

4. A centrifugal separator comprising:

a centrifugal bottomed main rotor body, projections are formed in an upper surface of bottom wall of said main rotor body;

first and second racks respectively having concavities formed in a lower surface of said racks, projections being formed on an upper surface of said racks, concavities being formed on a lower surface of said racks, and configured with multiple rack parts arranged along an inner circumferential surface of said main rotor body; said rack having a ring shape; and at multiple locations respectively in said racks, one slit is formed in a radial direction so as to completely cut and separate said rack, and other slits are made in radial directions which cut said rack while leaving a portion of inner circumferential edge thereof, and said rack parts are formed so as to be divided by these slits, projections being formed on an upper surface of said first rack, said second rack is mounted on said first rack; wherein;

said first rack engages with said main rotor body by said projections and concavities and said second rack engages said first rack by said projections and concavities, such that said first and second racks are restricted to same direction of turning as said main rotor body, and when said main rotor body is being turned, said rack parts are pressed against said inner circumferential surface of said main rotor body and made stationery there by centrifugal forces associated with turning of said main rotor body.

5. The centrifugal separator according to claim 4, wherein said rack comprises a ring-shaped main rack arranged inside said main rotor body, and auxiliary racks accommodating pluralities of tubes; and auxiliary rack accommodation holes are formed about entire circumference of said main rack.

* * * * *